US005885070A

United States Patent [19]

Lin

[11] Patent Number: 5,885,070

[45] Date of Patent: Mar. 23, 1999

[54] GAS CONTROL MECHANISM

[76] Inventor: Arlo H. T. Lin, No. 48-5, Sha Tyan Road, Sha Lu Chen, Taichung Hisen, Taiwan

[21] Appl. No.: 116,538

[22] Filed: Jul. 16, 1998

[51] Int. Cl.[6] ..... F23Q 7/12

[52] U.S. Cl. ..... 431/255; 431/344; 431/345

[58] Field of Search ..... 431/344, 345, 431/255, 256, 254, 258, 143, 266; 126/406

[56] References Cited

U.S. PATENT DOCUMENTS

| | | | |
|---|---|---|---|
| 5,082,440 | 1/1992 | Yamamoto | 431/255 |
| 5,304,060 | 4/1994 | Lin | 431/255 |
| 5,460,520 | 10/1995 | Lin | 431/344 |
| 5,505,614 | 4/1996 | Lin | 431/344 |
| 5,531,592 | 7/1996 | Tsai | 431/344 |
| 5,564,918 | 10/1996 | Lin | 431/255 |

*Primary Examiner*—James C. Yeung
*Attorney, Agent, or Firm*—Charles E. Baxley, Esq.

[57] ABSTRACT

A gas control mechanism includes a housing having a chamber for receiving a lighter and having an upper wall and a mouth secured on top. The lighter has a gas nozzle and a pivot lever having one end coupled to the gas nozzle. A tube has one end extended through the upper wall and coupled to the mouth and has a gasket secured to the bottom for engaging with the gas nozzle. The gasket includes an orifice for receiving gas from the gas nozzle. A spring may bias the gasket to engage with the gas nozzle, and a trigger may actuate the lever to actuate the gas nozzle. The gas nozzle is forced to engage with the gasket and to make an air tight seal between the tube and the gas nozzle when the gas nozzle is actuated by the trigger via the lever.

4 Claims, 2 Drawing Sheets

GAS CONTROL MECHANISM

BACKGROUND OF THE INVENTION

1. Field of the Invention

The present invention relates to a control mechanism, and more particularly to a gas control mechanism.

2. Description of the Prior Art

Typical gas welders comprise a complicated control mechanism for controlling the outward flow of the gas which may not be easily manufactured and assembled and which may not be easily operated by the user when in use. In addition, the typical lighter that is engaged in a housing may not be easily actuated and operated.

The present invention has arisen to mitigate and/or obviate the afore-described disadvantages of the conventional gas welders.

SUMMARY OF THE INVENTION

The primary objective of the present invention is to provide a gas control mechanism which includes a greatly simplified configuration for allowing the control mechanism to be easily and quickly manufactured and assembled and to be effectively operated.

In accordance with one aspect of the invention, there is provided a gas control mechanism comprising a housing including a chamber formed therein and including an upper wall, and including a mouth provided on top thereof, a lighter disposed in the chamber of the housing and including a gas nozzle and including lever having a middle portion pivotally secured on top of the lighter at a pivot, the lever including a first end and a second end coupled to the gas nozzle for actuating the gas nozzle, a tube including a first end extended through the upper wall and coupled to the mouth, the tube including a bottom portion having a gasket secured therein for engaging with the gas nozzle, the gasket including an orifice formed therein for receiving gas from the gas nozzle, means for biasing the gasket to engage with the gas nozzle, and a trigger means for actuating the lever to actuate the gas nozzle. The gas nozzle is forced to engage with the gasket by the lever and to make an air tight seal between the tube and the gas nozzle when the gas nozzle is actuated by the trigger means via the lever.

The gasket includes an upper end of greater size force-fitted in the bottom portion of the tube and includes a lower end of smaller size extended outward of the tube to engage with the gas nozzle.

A limiting means is further provided for limiting a relative movement between the tube and the wall. The limiting means includes a stop secured to the first end of the tube and forced to engage with the upper wall by the biasing means.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
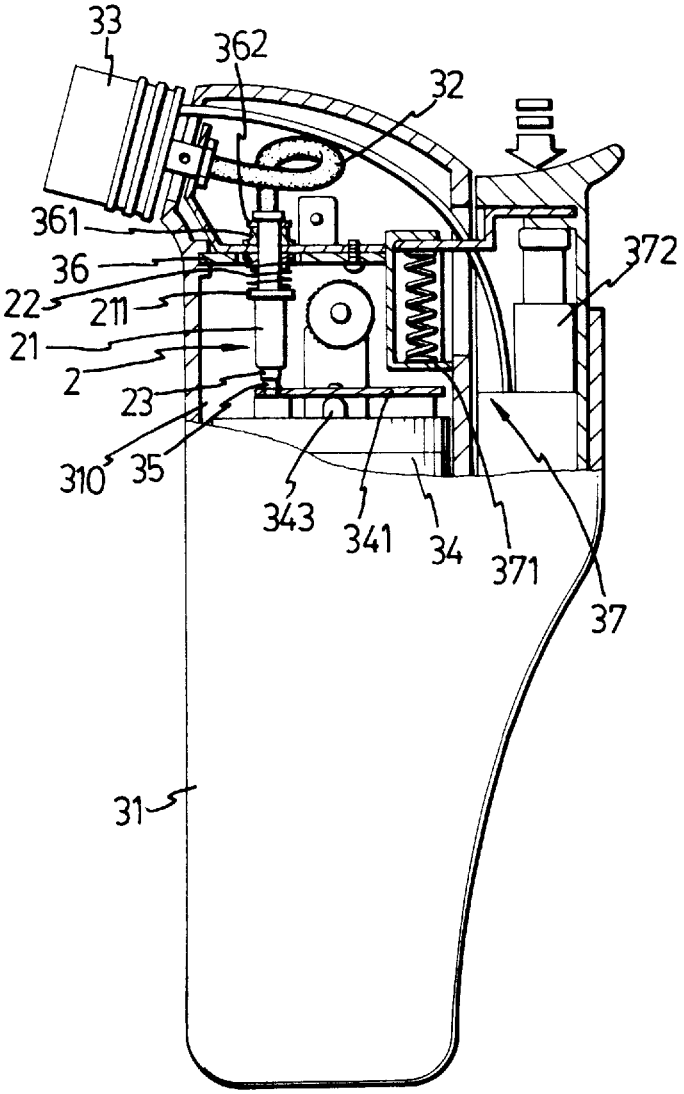
FIG. 1 is a plan view of a gas control mechanism in accordance with the present invention, in which a portion of the control mechanism is cut off for showing the structure of the control mechanism.
Figure 2:
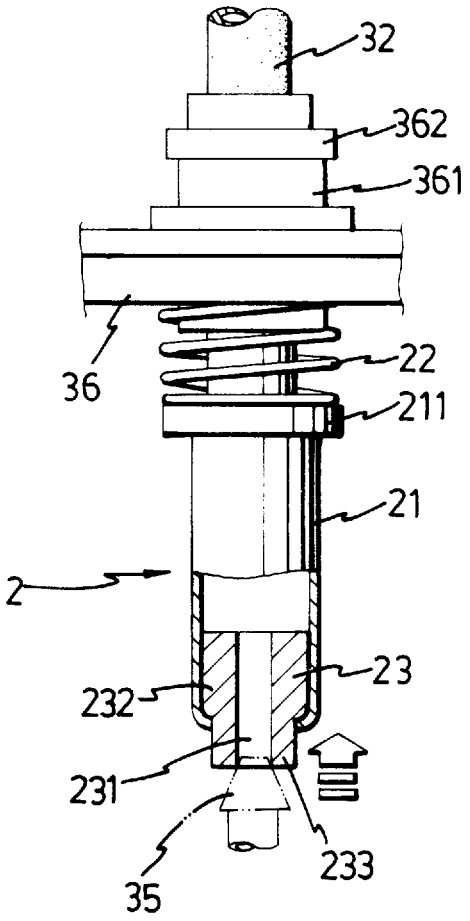
FIG. 2 is a partial plan view of the control mechanism.

Referring to the drawings, a gas control mechanism in accordance with the present invention comprises a housing

31 including an upper wall 36 and a chamber 310 formed therein for receiving and securing a typical lighter 34. The typical lighter 34 includes a lever 341 laterally secured on top and having a middle portion engaged on top of a pivot 343 for allowing the lever 341 to be moved about the pivot 343. The lever 341 includes one end engaged with a typical gas nozzle 35 of the typical lighter 34 and includes the other end to be actuated by a trigger device 37 which includes a trigger 372 having a typical spring-biased actuator member 371 to engage with and to depress the other end of the lever 341 and to actuate the gas nozzle 35. The housing 31 includes a mouth 33 provided on top thereof and includes a hose 32 coupled to the mouth 33.

A control mechanism 2 includes a tube 21 having an upper end extended upward through the upper wall 36 and coupled to the hose 32 for supplying the gas into the mouth 33. A ring-shaped stop 361 is secured on the upper end of the tube 21 by a fastener, such as a clamping ring 362. The tube 21 includes an annular flange 211 extended radially outward from the middle portion. A spring 22 is engaged between the wall 36 and the annular flange 211 for biasing the tube 21 downward toward the gas nozzle 35. The stop 361 may limit the movement of the tube 21 relative to the wall 36 and may prevent the tube 21 from being disengaged from the wall 36. The tube 21 includes a gasket 23 secured in the bottom end and having an orifice 231 for receiving the gas nozzle 35 and for receiving the gas from the gas nozzle 35 of the typical lighter 34. The gasket 23 is preferably made of rubber materials having a suitable resilience. The spring 22 may bias the gasket 23 to engage with the gas nozzle 35. The gasket 23 includes an upper end 232 of greater size for force-fitted in the bottom end of the tube 21 and includes a lower end 233 of smaller size and extended downward through the bottom end of the tube 21 for engaging with the gas nozzle 35.

In operation, as shown in FIG. 1, when the trigger 372 of the trigger device 37 is depressed by the user, the actuator member 371 may be actuated to depress the other end of the lever 341 and to elevate the gas nozzle 35 to engage with the gasket 23 and to make an excellent air tight between the tube 21 and the gas nozzle 35, such that the gas of the lighter 34 may flow out through the gas nozzle 35 and may safely and effectively flow into the tube 21 via the orifice 231 of the gasket 23. When the lever 341 is released, the spring 22 may recover the tube 21 and the gas nozzle 35.

Accordingly, the gas welder in accordance with the present invention includes a tube 21 having a gasket 23 that may be effectively and safely engaged with the gas nozzle 35 for allowing the gas to flow into the tube 21 and for making an excellent air tight between the tube 21 and the gas nozzle 35.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A gas control mechanism comprising:

a housing including a chamber formed therein and including an upper wall, and including a mouth provided on top thereof, a lighter disposed in said chamber of said housing and including a gas nozzle and including lever having a middle portion pivotally secured on top of said lighter at a pivot, said lever including a first end and a second end coupled to said gas nozzle for actuating said gas nozzle, a tube including a first end extended through said upper wall and coupled to said mouth, said tube including a bottom portion having a gasket secured therein for engaging with said gas nozzle, said gasket including an orifice formed therein for receiving gas from said gas nozzle, means for biasing said gasket to engage with said gas nozzle, and a trigger means for actuating said lever to actuate said gas nozzle, said gas nozzle being forced to engage with said gasket by said lever and to make an air tight seal between said tube and said gas nozzle when said gas nozzle is actuated by said trigger means via said lever.

2. The gas control mechanism according to claim 1, wherein said gasket includes an upper end of greater size force-fitted in said bottom portion of said tube and includes a lower end of smaller size extended outward of said tube to engage with said gas nozzle.

3. The gas control mechanism according to claim 1 further comprising means for limiting a relative movement between said tube and said wall.

4. The gas control mechanism according to claim 3, wherein said limiting means includes a stop secured to said first end of said tube and forced to engage with said upper wall by said biasing means.

* * * * *